US009669645B1

(12) United States Patent
Mayer et al.

(10) Patent No.: US 9,669,645 B1
(45) Date of Patent: Jun. 6, 2017

(54) GREETING CARD WITH REMOVABLE DISC

(71) Applicant: American Greetings Corporation, Cleveland, OH (US)

(72) Inventors: David Mayer, Bay Village, OH (US); Dave Sapp, Avon Lake, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 15/161,253

(22) Filed: May 22, 2016

(51) Int. Cl.
*G09F 1/00* (2006.01)
*G09F 1/08* (2006.01)
*B42D 15/02* (2006.01)
*B42D 15/04* (2006.01)

(52) U.S. Cl.
CPC ..... *B42D 15/022* (2013.01); *B42D 15/045* (2013.01)

(58) Field of Classification Search
CPC ..... B42D 15/042; B42D 15/045; G09F 1/04; G09F 1/00
USPC ..... 40/124.01–124.08
See application file for complete search history.

(56) References Cited

U.S. PATENT DOCUMENTS 4,509,280 A * 4/1985 Smith ..... B42D 15/04 40/124.191
4,613,157 A * 9/1986 Drabish ..... B42D 15/045 229/68.1
5,613,612 A * 3/1997 Davault ..... G11B 23/40 206/308.1
5,669,165 A * 9/1997 Santorsola ..... G09F 11/23 116/316
6,090,461 A * 7/2000 Frank ..... B44C 1/105 40/768
6,966,135 B1 * 11/2005 McDonald ..... G11B 33/0422 206/232
8,205,365 B2 * 6/2012 Taylor ..... B42D 15/0093 40/124.03
8,763,286 B2 * 7/2014 Jin ..... G09F 1/04 40/124.03
8,850,726 B2 * 10/2014 Dennis ..... G09F 1/04 40/124.03
8,887,418 B2 * 11/2014 Mayer ..... G09F 1/00 40/124.03
8,887,420 B2 * 11/2014 Nelson ..... A63H 33/38 40/124.03
8,904,678 B2 * 12/2014 Dennis ..... B42D 15/0093 40/124.03
9,394,095 B2 * 7/2016 Hartman ..... A63H 27/001
2007/0266605 A1 * 11/2007 Halbur ..... G09F 1/00 40/674
2011/0094132 A1 * 4/2011 DeFranco ..... B42D 15/045 40/124.06

(Continued)

FOREIGN PATENT DOCUMENTS

CA 2310961 12/2001
JP 2007050197 3/2007

*Primary Examiner* — Shin Kim
(74) *Attorney, Agent, or Firm* — Christine Flanagan

(57) ABSTRACT

A greeting card which includes a greeting card body and a flying disc removably attached thereto. A sound module and motion sensor are contained within the flying disc. The sound module contains one or more audio clips contained thereon and is operative to replay the one or more audio clips through a speaker. The motion sensor triggers the audio playback upon the flying disc being tossed or thrown through the air by a user.

20 Claims, 2 Drawing Sheets

(56) References Cited

U.S. PATENT DOCUMENTS

| | | | | |
|---|---|---|---|---|
| 2011/0250819 | A1* | 10/2011 | Tashman | A63H 33/18 446/46 |
| 2012/0011751 | A1* | 1/2012 | Schimke | B42D 15/022 40/124.03 |
| 2013/0104431 | A1* | 5/2013 | Jin | G09F 1/04 40/124.03 |
| 2013/0126598 | A1* | 5/2013 | Beadles | G06K 19/005 235/375 |
| 2013/0283651 | A1* | 10/2013 | Marsh | B42D 15/0093 40/124.03 |
| 2014/0068977 | A1* | 3/2014 | Marsh | B42D 15/0093 40/124.03 |
| 2015/0059218 | A1* | 3/2015 | Daniels | B42D 1/007 40/124.01 |
| 2015/0224808 | A1* | 8/2015 | Shlonsky | B42D 15/045 40/124.02 |

* cited by examiner

GREETING CARD WITH REMOVABLE DISC

RELATED APPLICATIONS

There are no applications related to this application.

FIELD OF THE INVENTION

The present invention is in the field of social expression products, and more specifically directed to an interactive greeting card with removable flying disc with audio capabilities.

SUMMARY OF THE INVENTION

A greeting card which includes a greeting card body and a flying disc removably attached thereto. A sound module and motion sensor are contained within the flying disc. The sound module contains one or more audio clips contained thereon and is operative to replay the one or more audio clips through a speaker. The motion sensor triggers the audio playback upon the flying disc being tossed or thrown through the air by a user.

DETAILED DESCRIPTION OF PREFERRED AND ALTERNATE EMBODIMENTS

Figure 2:
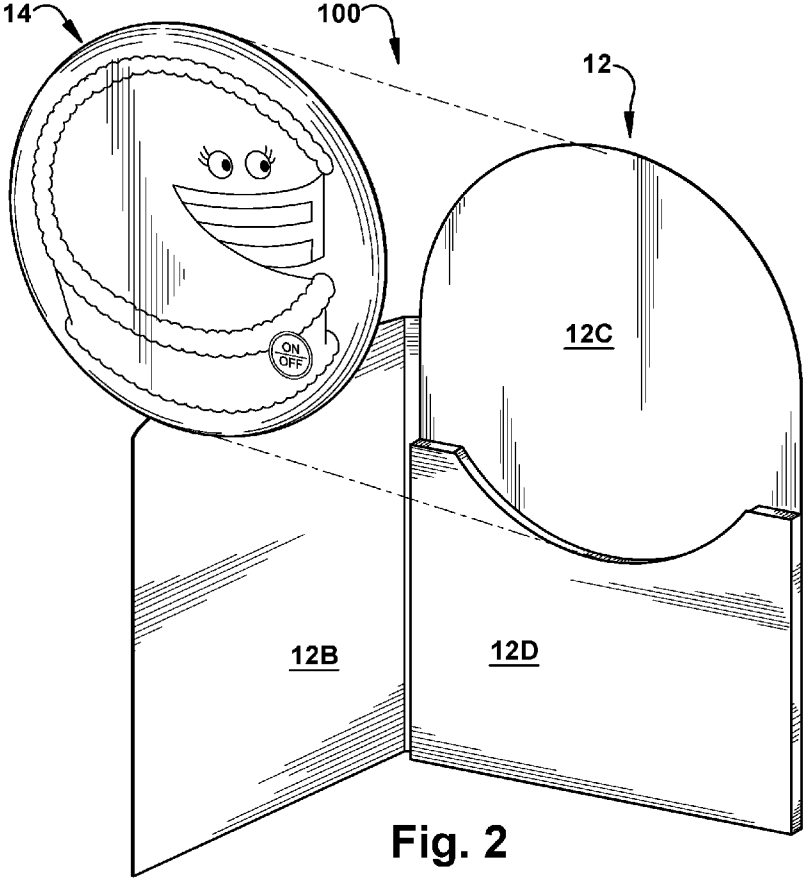
FIG. 2 is a perspective view of the greeting card of FIG. 1, with flying disc removed from the greeting card.
Figure 1:
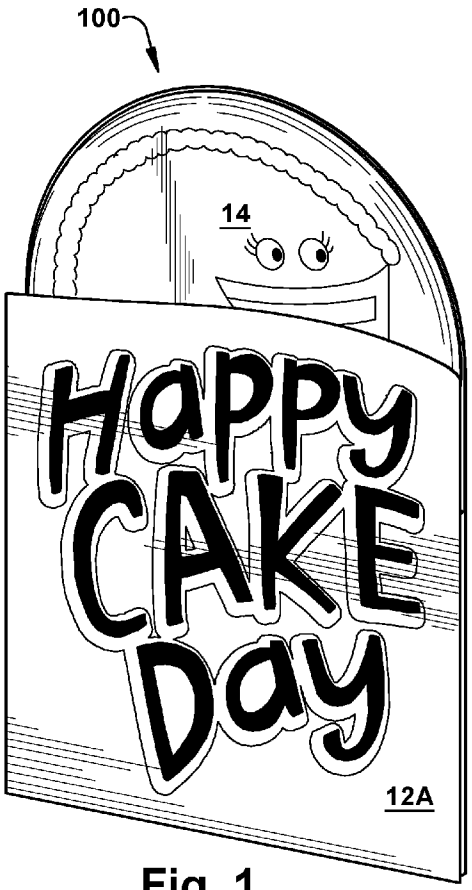
FIG. 1 is a perspective view of the greeting card of the present invention, with flying disc attached to the greeting card.
Figure 3:
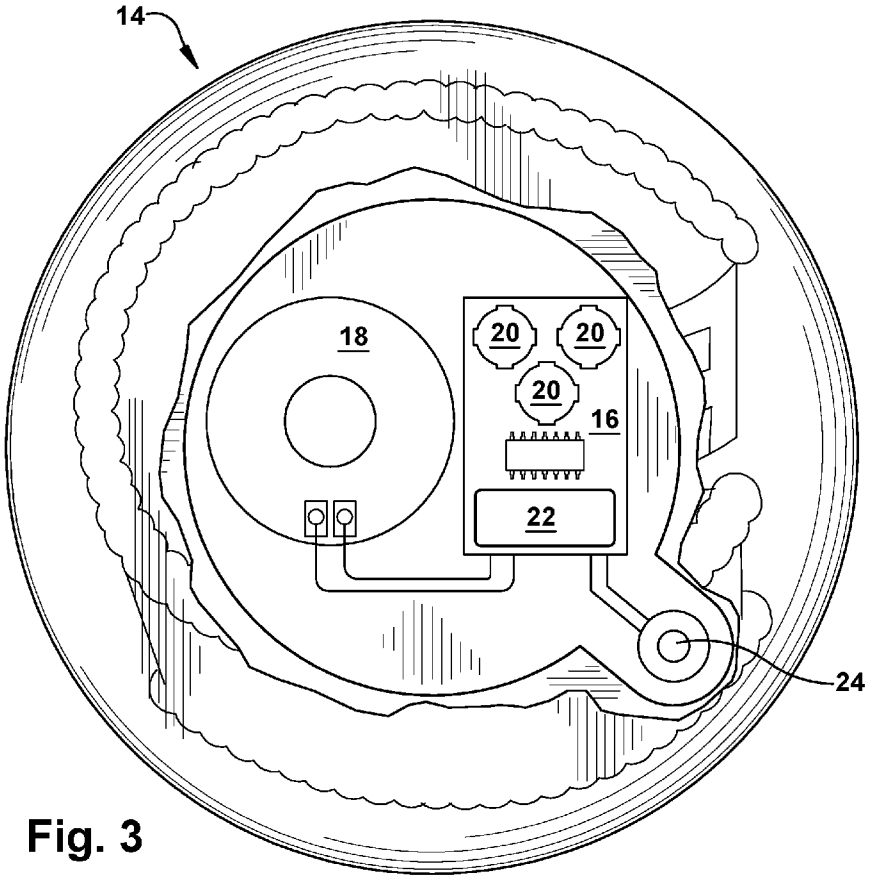
FIG. 3 is a tear-away view of the flying disc.

The greeting card 100 of the present disclosure and related inventions includes a greeting card body 12 and a removable flying disc 14 (also referred to herein as "the disc") having audio capabilities. The flying disc 14 is a circular-shaped gliding toy that is used for throwing and catching. This type of toy is often referred to as a Frisbee®.

The greeting card body 12, in a preferred embodiment, includes foam and paperboard. A front panel is attached to a first side tab panel along a first fold line, the first side tab panel is attached to a rear panel along a second fold line, the rear panel is attached to a second side tab panel along a third fold line, the second side tab panel is attached to an inside panel along a fourth fold line, and the inside panel is attached to a third side tab panel along a fifth fold line. Each panel has a front surface and a rear surface opposite the front surface. The single, contiguous panel is folded along the various fold lines into a two-panel greeting card which wraps around and conceals a molded foam insert. The rear surface of the front panel serves as the front cover 12A of the greeting card body 12 and the front surface of the front panel serves as the inside left panel 12B of the greeting card body 12. The rear surface of the rear panel serves as the back cover 12E of the greeting card body 12, the front surface of the rear panel serves as the upper portion of the inside right panel 12C and the rear surface of the inside panel serves as the lower portion of the inside right panel 12D of the greeting card body 12. The front cover 12A (and inside left panel) of the greeting card body 12 is slightly shorter than the rear cover 12D. As mentioned above, the greeting card body 12 folds to wrap around and conceal a molded foam insert that is located between the inside right panel and the back cover of the greeting card body 12. The covered, molded foam insert adds a thickness to the greeting card body 12 to accommodate the removable flying disc 14 attached to the greeting card body 12, as described in further detail below. Each panel of the greeting card body 12 may contain printing thereon such as text sentiment, graphics, photos, drawings, pictures, or any other type of printing. The greeting card body 12 may also have various embellishments attached thereto to add a three-dimensional effect to the greeting card.

The flying disc 14 is removably attached to the upper portion of the inside right panel 12C of the greeting card body 12 (or front surface of the back cover panel). In a preferred embodiment, the disc 14 is attached to the greeting card body 12 via a thin string or filament, however, any other type of removable attachment device may be used, such as a weak adhesive, hook and loop patches, snap, paper tabs, etc. The disc 14 is made of molded, flexible foam in a circular shape having one or more cavities or openings therein. A sound module and other electric or mechanical devices are contained within the one or more cavities within the disc 14. The sound module is capable of storing and replaying one or more sound or audio files or clips which are stored on a memory device. The sound module may include, but is not limited to: a circuit board with integrated circuit chip 16, a speaker 18, a memory device, one or more sound files or clips stored on said memory device, a power source 20 such as one or more batteries, various wires and electronics which attach the various components of the sound module to the circuit board, and any other component which is necessary or which facilitates or improves the storage and replay of sound or audio files or clips through a speaker. These types of components are known to one having ordinary skill in the art. In addition to the sound module, the disc 14 also includes a motion sensor 22 such that when the disc 14 is turned on and thrown or tossed, shaken, or otherwise moved, the motion sensor 22 detects the motion and triggers replay of one of the one or more sound or audio files or clips. In a preferred embodiment, the disc 14 plays eight different audio clips, first through a pre-determined sequence and then randomized. These clips may alternately be replayed in a specific order on a loop or they may be selected and played at random. The disc 14 also contains an on/off switch which is a push button 24 accessed through a front surface of the disc 14. The push button 24 operates as a toggle switch wherein pushing once turns the disc to the "on" position and pushing a second time returns the disc to the "off" position, and so on. The disc 14 may contain printing, a sticker, or other indication of the location of the push button on/off switch 24. The disc 14 will not play audio when tossed or thrown unless the on/off switch 24 has been moved to the "on" position. The audio will go to sleep when it is idle for 40 seconds or more. The audio clips may be spoken word, instrumental music, a song or portion thereof, a noise or any other recordable sound. The disc 14 may have printing thereon, such as text, pictures, drawings, photos or any other type of printing. The disc 14 may be printed in a particular design to resemble physical objects, such as a pizza, a donut, a flower or a cake.

In other embodiments, the greeting card may also contain an additional sound module, attached to the greeting card body 12, that emits sound upon opening the greeting card body 12 or pushing a button or performing some other interactive function. Both the greeting card body 12 and the disc 14 may contain additional special effects such as one or more lights that blink, flicker, flash or perform some other pre-determined lighting sequence. The greeting card and disc may also additionally contain a motor which may be used to effect movement of a mobile object attached to the greeting card body or disc. In an alternate embodiment, in addition to the pre-recorded sound capabilities, the disc may contain a microphone which allows users to record and save one or more personal messages to be played back upon turning the disc to the "on" position and shaking, throwing, tossing or effecting some other type of movement. The greeting card may contain this feature as well. In still another embodiment, the flying disc described herein may be attached to a gift bag or gift box.

The greeting card with flying disc 100 of the present disclosure and related inventions provides a somewhat traditional greeting card with attached toy or keepsake. Once the greeting card 100 has been presented to the recipient, the flying disc 14 can be removed and kept as a toy or memento of the occasion. The recipient can have fun with the disc 14 long after the greeting card body 12 has been discarded.

While the greeting card has been described herein and shown in the figures with respect to a preferred embodiment and as having a specific number of panels and format, other greeting card body configurations may be used. The disc has also been described as being attached to a specific location inside the greeting card, the disc may be attached to a front panel of the greeting card or any other panel. The greeting card and disc may also be made of any other material than those described herein with respect to the preferred embodiment. The number and sequence of audio playback may also be altered from what is stated herein while still remaining within the scope of the present invention.

The invention claimed is:

1. A greeting card comprising:

a greeting card body;

a frisbee removably attached to the greeting card body, the frisbee having one or more cavities contained therein;

a sound module contained within the one or more cavities of the frisbee, the sound module having at least one audio file contained therein and operative to replay the audio file through a speaker;

a motion sensor which triggers playback of the at least one audio file upon movement of the frisbee.

2. The greeting card of claim 1 further comprising an on/off switch.

3. The greeting card of claim 2, wherein the motion sensor only triggers playback of the at least one audio file when the on/off switch is turned to the "on" position.

4. The greeting card of claim 1, wherein a portion of the frisbee can be seen from a front view of the greeting card, when the greeting card is in a closed position.

5. The greeting card of claim 1, wherein the sound module contains a plurality of audio clips.

6. The greeting card of claim 5, wherein the plurality of audio clips are replayed in a predetermined order.

7. The greeting card of claim 5, wherein the plurality of audio clips are replayed in a random order.

8. A greeting card comprising:

a greeting card body;

a flying disc toy attached to the greeting card body;

a sound module contained within the flying disc toy, the sound module having one or more audio clips saved thereon and means for replaying said one or more audio clips;

a motion sensor contained within the flying disc toy which triggers replay of the one or more audio clips each time the flying disc toy is thrown or tossed in the air.

9. The greeting card of claim 8 further comprising an on/off switch.

10. The greeting card of claim 9, wherein the motion sensor triggers replay of the one or more audio clips each time the flying disc toy is thrown or tossed in the air only when the on/off switch is in the "on" position.

11. The greeting card of claim 9, wherein the on/off switch is accessed through a front face of the flying disc toy.

12. The greeting card of claim 8, wherein the flying disc toy is made of foam.

13. The greeting card of claim 8, wherein the flying disc toy can be seen over a top edge of a front cover of the greeting card body.

14. The greeting card of claim 8, wherein the on/off switch is a push button.

15. The greeting card of claim 8, wherein the on/off switch operates as a toggle switch.

16. A greeting card comprising:

a greeting card body;

a flying disc toy removably attached to the greeting card body;

a sound module contained inside the flying disc toy, the sound module operative to store and playback at least one audio file;

a switch operative to trigger playback of the at least one audio file.

17. The greeting card of claim 16, wherein the switch is a motion sensor.

18. The greeting card of claim 16 further comprising an on/off switch.

19. The greeting card of claim 17, wherein the motion sensor triggers playback of the at least one audio file upon the flying disc toy being tossed or thrown by a user.

20. The greeting card of claim 16, wherein the flying disc toy can be seen above a front cover of the greeting card body.

* * * * *